US008640598B1

(12) United States Patent
Jackson

(10) Patent No.: US 8,640,598 B1
(45) Date of Patent: Feb. 4, 2014

(54) SLEEVE PISTON FOR ACTUATING A FIREARM BOLT CARRIER

(76) Inventor: Jason Stewart Jackson, Lincoln, NE (US)

( * ) Notice: Subject to any disclaimer, the term of this patent is extended or adjusted under 35 U.S.C. 154(b) by 2988 days.

(21) Appl. No.: 13/184,529

(22) Filed: Jul. 16, 2011

Related U.S. Application Data

(60) Provisional application No. 61/365,692, filed on Jul. 19, 2010.

(51) Int. Cl.
*F41A 5/20* (2006.01)

(52) U.S. Cl.
USPC ..... 89/191.02; 89/191.01

(58) Field of Classification Search
USPC ..... 89/191.01, 191.02, 192, 193
See application file for complete search history.

(56) References Cited

U.S. PATENT DOCUMENTS

| | | | | | |
|---|---|---|---|---|---|
| 696,306 | A | | 3/1902 | Benet | |
| 877,657 | A | | 1/1908 | Mason | |
| 958,545 | A | | 6/1909 | Ross | |
| 1,402,459 | A | | 1/1922 | Swebilius | |
| 1,430,662 | A | * | 10/1922 | Lewis | 89/185 |
| 1,802,816 | A | | 4/1931 | Holek | |
| 1,846,993 | A | | 2/1932 | Destree | |
| 2,093,706 | A | | 9/1937 | Browning | |
| 2,186,582 | A | | 1/1940 | Gebauer | |
| 2,211,405 | A | * | 8/1940 | Browning | 89/193 |
| 2,252,754 | A | * | 8/1941 | Browning | 89/193 |
| 2,340,293 | A | | 2/1944 | Balleisen | |
| 2,386,205 | A | | 10/1945 | Garand | |
| 2,388,396 | A | | 11/1945 | Eklund | |
| 2,393,627 | A | | 1/1946 | Garand | |
| 2,456,290 | A | | 12/1948 | Ljutic | |
| 2,457,835 | A | | 1/1949 | Schiff | |
| 2,462,119 | A | | 2/1949 | Moore | |
| 2,484,694 | A | | 10/1949 | Dicke | |
| 2,494,889 | A | * | 1/1950 | Maillard | 89/193 |
| 2,554,618 | A | | 5/1951 | Dixon | |
| 2,628,536 | A | | 2/1953 | Schaich | |
| 2,637,247 | A | | 5/1953 | Hester | |
| 2,715,858 | A | | 8/1955 | Hoppert | |
| 2,771,819 | A | | 11/1956 | Morse | |
| 2,777,366 | A | | 1/1957 | Cook | |
| 2,582,989 | A | | 1/1958 | Harvey | |
| 2,887,013 | A | | 5/1959 | Marsh | |
| 2,909,101 | A | | 10/1959 | Hillberg | |
| 2,918,847 | A | | 12/1959 | Barr | |

(Continued)

OTHER PUBLICATIONS

AK-47 Instruction & Safety Manual.

(Continued)

*Primary Examiner* — Jonathan C Weber

(57) ABSTRACT

The embodiments described herein relate generally to a sleeve piston for operating the bolt carrier of a firearm. The sleeve piston can comprise a monolithic sleeve piston or it can comprise two or more sleeve-piston parts, thereby evenly distributing the reciprocating mass of an auto-loading firearm about its barrel, minimizing muzzle rise. The sleeve piston can further be coupled to the bolt carrier by two or more operating rods, thereby reducing the tipping force or off-axis torque experienced by the bolt carrier during firearm operation. The sleeve piston can also reciprocate in a sleeve gas block coupled to a barrel, thereby helping to transfer heat away from the barrel. The sleeve piston embodiments of the present invention provide a balanced and compact operating mechanism that is ideally suited for rifles, carbines, and personal-defense weapons.

20 Claims, 10 Drawing Sheets

(56) References Cited

U.S. PATENT DOCUMENTS 2,918,848 A 12/1959 Maillard
2,951,424 A 9/1960 Stoner
2,956,481 A 10/1960 Barr
2,983,196 A 5/1961 Dixon
2,987,967 A 6/1961 Wild
2,987,968 A 6/1961 Janson
3,088,378 A 5/1963 Boudrcan
3,125,930 A 3/1964 Gilbert
3,166,983 A 1/1965 Lizza
3,207,036 A 9/1965 Norton
3,246,567 A 4/1966 Miller
3,285,133 A 11/1966 Fowler
3,306,168 A 2/1967 Blumrick
3,323,418 A 6/1967 Loflller
3,329,064 A 7/1967 Segrest
3,330,183 A 7/1967 Loffler
3,365,828 A 1/1968 Badali
3,424,053 A 1/1969 Close
3,443,477 A 5/1969 Kaempf
3,444,641 A 5/1969 Ruger
3,568,564 A 3/1971 Badali
3,592,101 A 7/1971 Vartanian et al.
3,601,002 A 8/1971 Janson
3,618,457 A 11/1971 Miller
3,657,960 A 4/1972 Badali
3,680,434 A 8/1972 Muhlemann
3,690,219 A 9/1972 Mumemann et al.
3,707,110 A 12/1972 Alday
3,709,092 A 1/1973 Tazome
3,715,955 A 2/1973 Folley
3,736,839 A 6/1973 Childers
3,774,500 A 11/1973 Into
3,776,096 A 12/1973 Donovan
3,810,412 A 5/1974 Zamacola
3,848,511 A 11/1974 Zanoni
3,869,961 A 3/1975 Kawamura
3,886,844 A 6/1975 Kepplinger
3,945,296 A 3/1976 Hyytinen
3,968,727 A 7/1976 Hyytinen
3,988,964 A 11/1976 Moore
3,990,348 A 11/1976 Vesamaa
3,999,461 A * 12/1976 Johnson et al. ..... 89/191.01
3,999,534 A 12/1976 Chapin
4,010,673 A 3/1977 Kepplinger
4,014,247 A 3/1977 Tollinger
4,015,512 A 4/1977 Feerick
4,019,423 A 4/1977 Johnson
4,028,994 A 6/1977 Ferluga
4,056,038 A 11/1977 Rath
4,058,922 A 11/1977 Elbe
4,061,075 A 12/1977 Smith
4,085,654 A 4/1978 Panigoni
4,088,057 A 5/1978 Nasypany
4,095,507 A 6/1978 Close
4,102,242 A 7/1978 Liedke
4,102,243 A 7/1978 Jennie
4,109,558 A 8/1978 Panigoni
4,125,054 A 11/1978 Jennie
4,126,077 A 11/1978 Quesnel
4,151,782 A 5/1979 Allen
4,174,654 A 11/1979 Liedke
4,178,832 A 12/1979 Crowell
4,207,798 A 6/1980 Hayashi
4,244,273 A 1/1981 Langendorfer
4,279,191 A 7/1981 Johansson
4,324,170 A 4/1982 Healy
4,335,643 A 6/1982 Gal
4,373,423 A 2/1983 Moore
4,389,920 A 6/1983 Dufour
4,395,838 A 8/1983 Civolani
4,395,937 A 8/1983 Ottolini
4,409,883 A 10/1983 Nyst
4,414,880 A 11/1983 Throner
4,433,610 A 2/1984 Tatro
4,433,611 A 2/1984 Baumann
4,475,438 A 10/1984 Sullivan
4,505,183 A 3/1985 Grehl
4,538,502 A 9/1985 Benelli
4,553,469 A 11/1985 Atchisson
4,563,937 A 1/1986 White
4,599,934 A 7/1986 Palmer
4,604,942 A 8/1986 Benelli
4,619,184 A 10/1986 Shalev
4,649,800 A 3/1987 Tessier
4,658,702 A 4/1987 Tatro
4,702,146 A 10/1987 Ikeda
4,709,617 A 12/1987 Anderson
4,765,224 A 8/1988 Morris
4,817,496 A 4/1989 Zedrosser
4,821,621 A 4/1989 Lorenzo
4,872,392 A 10/1989 Powers
4,901,623 A 2/1990 Lee
5,103,714 A 4/1992 LaFrance
5,123,329 A 6/1992 Irwin
5,173,564 A 12/1992 Hammond
5,218,163 A 6/1993 Dabrowski
5,272,956 A 12/1993 Hudson
5,274,939 A 1/1994 Scaramucci
5,279,202 A 1/1994 Bellardi
5,287,642 A 2/1994 Scaramucci
5,351,598 A 10/1994 Schuetz
5,404,790 A 4/1995 Averbukh
5,429,034 A 7/1995 Badali
5,448,940 A 9/1995 Schuetz
5,499,569 A 3/1996 Schuetz
5,520,019 A 5/1996 Schuetz
5,551,179 A 9/1996 Young
5,570,676 A 11/1996 Gore
5,628,137 A 5/1997 Cortese
5,634,288 A 6/1997 Martel
5,726,377 A 3/1998 Harris
5,737,865 A 4/1998 Brandl
5,760,328 A 6/1998 Robbins
5,767,434 A 6/1998 Hirtl
5,768,818 A 6/1998 Rustick
5,824,943 A 10/1998 Guhring
5,827,991 A 10/1998 Predazzer
5,827,992 A 10/1998 Harris
5,834,678 A 11/1998 Kalb
5,872,323 A 2/1999 Norton
5,937,558 A 8/1999 Gerard
5,939,659 A 8/1999 Dobbins
5,945,626 A 8/1999 Robbins
5,959,234 A 9/1999 Scaramucci
5,983,549 A 11/1999 Battaglia
6,019,024 A 2/2000 Robinson
6,029,645 A 2/2000 Wonisch
6,112,636 A 9/2000 Besselink
6,182,389 B1 2/2001 Lewis
6,243,978 B1 6/2001 Vignaroli
6,276,354 B1 8/2001 Dillon
6,343,536 B1 2/2002 Rossier
6,374,528 B1 4/2002 Davis
6,374,720 B1 4/2002 Tedde
6,382,073 B1 5/2002 Beretta
6,405,631 B1 6/2002 Milek
6,508,160 B2 1/2003 Beretta
6,606,934 B1 8/2003 Rock
6,609,319 B1 8/2003 Olson
6,619,592 B2 9/2003 Vignaroli
6,622,610 B2 9/2003 Adkins
6,634,274 B1 10/2003 Herring
6,662,485 B2 12/2003 Kay
6,681,677 B2 1/2004 Herring
6,722,255 B2 4/2004 Herring
6,775,942 B2 8/2004 Compton
6,834,455 B2 12/2004 Burigana
6,848,351 B1 2/2005 Davies
6,886,286 B2 5/2005 Dowding
6,889,461 B2 5/2005 Vignaroli
6,971,202 B2 12/2005 Bender
7,131,228 B2 11/2006 Hochstrate
7,137,217 B2 11/2006 Olson
7,162,822 B1 1/2007 Heayn

(56) References Cited

U.S. PATENT DOCUMENTS

| | | | | |
|---|---|---|---|---|
| 7,162,823 | B2 | 1/2007 | Schoppman | |
| 7,213,498 | B1 | 5/2007 | Davies | |
| 7,225,574 | B2 | 6/2007 | Crandall | |
| 7,231,864 | B2 | 6/2007 | Ratti | |
| 7,252,138 | B2 | 8/2007 | Burkhalter | |
| 7,311,032 | B2 | 12/2007 | Murello | |
| 7,316,091 | B1 | 1/2008 | Desomma | |
| 7,337,574 | B2 | 3/2008 | Crandall | |
| 7,343,844 | B2 | 3/2008 | Poff | |
| 7,347,021 | B1 | 3/2008 | Jones | |
| 7,356,957 | B1 | 4/2008 | Jones | |
| 7,418,898 | B1 | 9/2008 | Desomma | |
| 7,448,307 | B1 | 11/2008 | Dafinov | |
| 7,461,581 | B2 * | 12/2008 | Leitner-Wise | 89/191.01 |
| 7,469,624 | B1 | 12/2008 | Adams | |
| 7,587,956 | B2 | 9/2009 | Velasco | |
| 7,610,843 | B2 | 11/2009 | Beretta | |
| 7,610,844 | B2 | 11/2009 | Kuczynko | |
| 7,617,758 | B2 | 11/2009 | Gavage | |
| 7,621,210 | B2 | 11/2009 | Fluhr | |
| 7,634,959 | B2 | 12/2009 | Frickey | |
| 7,637,199 | B2 | 12/2009 | Fluhr | |
| 7,661,220 | B2 | 2/2010 | Crandall | |
| 7,739,939 | B2 | 6/2010 | Adams | |
| 7,775,149 | B2 | 8/2010 | Keeney | |
| 7,779,743 | B2 | 8/2010 | Herring | |
| 7,827,722 | B1 | 11/2010 | Davies | |
| 7,832,326 | B1 | 11/2010 | Barrett | |
| 7,856,917 | B2 | 12/2010 | Noveske | |
| 7,874,240 | B2 | 1/2011 | Akhavan | |
| 7,891,284 | B1 | 2/2011 | Barrett | |
| 7,938,055 | B2 | 5/2011 | Hochstrate | |
| 7,946,214 | B2 | 5/2011 | Stone | |
| 7,963,203 | B1 * | 6/2011 | Davies | 89/14.1 |
| 7,971,379 | B2 | 7/2011 | Robinson | |
| 7,971,382 | B2 | 7/2011 | Robinson | |
| 7,971,518 | B2 | 7/2011 | Adams | |
| 7,975,595 | B2 | 7/2011 | Robinson | |
| 8,051,595 | B2 | 11/2011 | Hochstrate | |
| 8,065,949 | B1 | 11/2011 | Molinari | |
| 8,109,193 | B2 | 2/2012 | Herring | |
| 8,109,196 | B1 | 2/2012 | Spence | |
| 8,117,958 | B2 | 2/2012 | Hochstrate | |
| 8,141,285 | B2 | 3/2012 | Brown | |
| 8,141,287 | B2 | 3/2012 | Dubois | |
| 8,161,864 | B1 | 4/2012 | Vuksanovich | |
| 8,176,837 | B1 | 5/2012 | Jackson | |
| 8,181,563 | B1 | 5/2012 | Peterken | |
| 8,201,489 | B2 | 7/2012 | Juarez | |
| 8,210,089 | B2 | 7/2012 | Brown | |
| 8,245,429 | B2 | 8/2012 | Kuczynko | |
| 8,245,626 | B2 | 8/2012 | Langevin | |
| 8,286,542 | B2 | 10/2012 | Griffin | |
| 2005/0115398 | A1 | 6/2005 | Olson | |
| 2007/0033851 | A1 * | 2/2007 | Hochstrate et al. | 42/75.01 |
| 2007/0199435 | A1 | 8/2007 | Hochstrate | |
| 2009/0000173 | A1 | 1/2009 | Robinson | |
| 2009/0031605 | A1 | 2/2009 | Robinson | |
| 2009/0031607 | A1 | 2/2009 | Robinson | |
| 2009/0120277 | A1 * | 5/2009 | Adams | 89/179 |
| 2010/0300277 | A1 * | 12/2010 | Hochstrate et al. | 89/179 |
| 2011/0023700 | A1 | 2/2011 | Herring | |
| 2011/0209377 | A1 * | 9/2011 | Davies | 42/16 |
| 2012/0152104 | A1 | 6/2012 | Audibert | |

OTHER PUBLICATIONS

AK-47 Semi-Automatic Rifle.

Armalite Inc Owner's Manual for AR-180B rifle, Armalite, Inc., Jun. 2009.

Barrett Operator's Manual .50 Caliber Rifle M82A1.

CMMG Piston Maintenance and Disassembly Instructions.

Czech Model Vz 52 & Vz 52/57 Rifles Operation and Maintenance Manual.

Exploded view of G41(W). Retrieved from the Internet:<http://claus.espeholt.dk/exploded_view_g41.html>.

FAL User's Manual Light Automatic Rifle, Fabrique Nationale Herstal.

Gewehr 41, Wikipedia. Retrieved from the Internet:< http://en.wikipedia.org/wiki/Gewehr_41>.

M6 Series Carbines Operator's Manual, LWRC International, LLC.

Magpul Masada Adaptive Combat Weapon System, Magpul Military Industries.

Shea, Dan, *British SA80 Rifles, The L85A1 and L86A1 LSW*, The Small Arms Review, vol. 6, No. 3, Dec. 2002.

SIG SAUER SIG556 Handling & Safety Instructions.

T-14, 36 (410) Calibre Semi-Automatic Shotgun User and Maintenance Manuel, Safir Arms Industrial Company Ltd.

Windham, Jeff, *Fire to Destruction Test of 5.56 M4A1 Carbine and M16A2 Rifle Barrels*, Final Report, Small Arms Branch, Engineering Support Directorate, Rock Island Arsenal, Sep. 1996.

* cited by examiner

SLEEVE PISTON FOR ACTUATING A FIREARM BOLT CARRIER

CROSS-REFERENCE TO RELATED APPLICATIONS

This application claims priority to U.S. Provisional Application No. 61/365,692, filed Jul. 19, 2010, which is herein incorporated by reference in its entirety.

BACKGROUND OF THE INVENTION

Piston-driven firearms as understood by those skilled in the art typically use an operating piston that reciprocates at some distance from a firearm barrel. An AK-47, for example, utilizes an operating piston that reciprocates above the firearm barrel. While the use of an offset operating piston can help provide reliability, offset pistons can make semi- and especially fully automatic firearms difficult to control because the offset piston's reciprocating mass creates a torque about the barrel. Accordingly, there is a need in the art for a firearm operating system that can provide the reliability advantages of a conventional offset piston while minimizing or even eliminating the barrel torque caused by an offset piston. Such a firearm operating system could provide numerous benefits for auto-loading firearms and would be especially useful for auto-loading rifles, carbines, and personal-defense weapons.

SUMMARY OF THE INVENTION

Embodiments of the present invention generally relate to a sleeve or hollow piston that can provide the reliability of conventional piston-driven operating systems while minimizing torque about the barrel. For example, in some embodiments the sleeve piston can actuate a bolt carrier by reciprocating along a barrel in response to a gas generated by a fired cartridge. The sleeve piston can comprise any suitable shape including circular, semi-circular, or polygonal in shape, or any combination thereof. The sleeve piston of any embodiment can comprise a single or monolithic sleeve that extends around the barrel of a firearm. In the alternative, the sleeve piston can comprise two or more sleeve parts, wherein each sleeve part can be shaped or curved around a portion of the firearm barrel. One or more operating rods can couple the sleeve piston to the bolt carrier. In some embodiments, first and second operating rods can be coupled to the sleeve piston at opposite, or substantially opposite, points on the sleeve piston such as at the top and bottom or at the left and right sides of the sleeve piston. The one or more operating rods can be permanently coupled, detachably coupled, or separate from the sleeve piston in any embodiment of the present invention. For example, in embodiments where the sleeve piston is separate from two operating rods, the sleeve piston can move a predetermined distance in response to a gas before transferring an actuating or operating force to, such as by striking, the operating rods. The sleeve piston can be coupled to a bolt carrier that reciprocates in a straight light with respect to the barrel, such as to an AR-18 or M-16-type bolt carrier, in any embodiment of the present invention. The bolt carrier of any embodiment can be used with or include a bolt that reciprocates linearly with the bolt carrier. For example, in various embodiments the bolt carrier can include a non-tilting rotating bolt, such as a seven-lug AR-18 or M-16-type bolt. Of course, embodiments of the present invention can also be used with tilting or tipping bolt carrier designs such those found in the SKS or FN FAL wherein the bolt tilts or tips in order to lock into position in a receiver. The one or more operating rods can contact or strike the bolt carrier at one or more contact points or lobes. For example, in some embodiments of the present invention a first operating rod and a second operating rod contact the bolt carrier on opposite or substantially opposite points of the bolt carrier. The sleeve piston of any embodiment can include one or more gas rings on an inner surface and/or one or more gas rings on an outer surface to effectuate a gas seal. The sleeve piston of any embodiment of the present invention can be used with the methods, systems, and firearms of any embodiment of the present invention.

The sleeve piston of any embodiment can be movably received by a gas block to define a gas or expansion chamber. The gas block can be permanently or detachably coupled to a barrel, or the gas block and barrel can comprise a single unit in embodiments of the present invention. For example, in one embodiment a sleeve piston can comprise a circular shape and can reciprocate in a corresponding circular sleeve cylinder in a gas block to define a gas chamber. The gas block can be detachably coupled to the barrel by a fastener such as by one or more pins or screws, or it can be machined from the barrel itself in embodiments of the invention. One or more gas ports can couple the gas chamber to the barrel in embodiments of the invention.

Another embodiment of the present invention provides a system for actuating a bolt carrier of a firearm. The system of any embodiment can be integrated with, or comprise, a firearm. The system can comprise a barrel coupled to a receiver, wherein the bolt carrier is carried by the receiver. A gas chamber can receive a gas from a fired cartridge. A gas port or gas pathway can couple the barrel to the gas chamber. The sleeve piston of any embodiment of the present invention can be used to actuate or operate the bolt carrier by moving along the barrel in response to a gas or gas pressure in the gas chamber. For example, the sleeve piston can comprise a single or monolithic sleeve piston that extends around the barrel of the firearm. In the alternative, the sleeve piston can comprise two or more sleeve parts, wherein each sleeve part is shaped around a portion of a firearm barrel. One or more operating rods can couple the sleeve piston to the bolt carrier. In some embodiments, first and second operating rods can be coupled to the sleeve piston at opposite, or substantially opposite, points on the sleeve piston such as at the top and bottom or at the left and right sides of the sleeve piston. The one or more operating rods can be permanently coupled to, detachably coupled to, or independent of the sleeve piston in any embodiment of the present invention. The sleeve piston can comprise any suitable shape including circular, semi-circular, or polygonal in shape, or any combination thereof. A spring over one or more operating rods can be used to return the sleeve piston to battery in any embodiment of the present invention. In addition or in the alternative, a firearm mainspring can be used to return the sleeve piston to battery in embodiments of the present invention.

In further embodiments, the bolt carrier can carry or include a non-tilting rotating bolt that reciprocates co-axially with respect to the barrel, such as an AR-18, M-16, or AK-47-type bolt. The bolt can comprise as a seven-lug AR-18 or M-16-type bolt, for example. By way of further example, the bolt of any embodiment can comprise a two-lug, AK-47-type rotating bolt. The one or more operating rods can contact or strike the bolt carrier at one or more contact points or lobes. For example, in some embodiments of the present invention a first operating rod and a second operating rod contact the bolt carrier on opposite or substantially opposite points or sides of the bolt carrier. In further embodiments, a gas block is coupled to the barrel and receives the gas from the fired cartridge. The sleeve piston can be movably received by the gas block to define a gas chamber. For example, at least a portion of the sleeve piston can fit within the gas block when the system is in battery. The gas block of any embodiment can be permanently coupled, detachably coupled, or integrated into or with a barrel. The system of any embodiment of the present invention can be used with the apparatuses, methods, and firearms of any embodiment of the present invention.

Further embodiments of the present invention provide a firearm that can include the various sleeve piston apparatus, system, and/or method embodiments of the present invention. In one such embodiment, the present invention provides a firearm comprising a barrel coupled to a receiver, a bolt carrier including a bolt and carried by the receiver, a sleeve piston that extends around the barrel, a gas block coupled to the barrel, and wherein the sleeve piston is movably received by the gas block to define a gas chamber that receives a gas from a projectile traveling along the barrel. The firearm can further include a gas port through which the gas flows from the barrel to the gas chamber. The sleeve piston can actuate the bolt carrier by reciprocating along the barrel in response to the gas in the gas chamber. The sleeve piston of any embodiment of the present invention can be used to actuate or operate the bolt carrier of the firearm embodiments of the present invention. For example, the sleeve piston can comprise a single or monolithic sleeve piston that extends around the barrel of the firearm. In the alternative, the sleeve piston can comprise two or more sleeve parts, wherein each sleeve part is shaped around a portion of a firearm barrel. The sleeve piston can comprise any suitable shape including circular, semi-circular, or polygonal in shape, or any combination thereof. One or more operating rods can couple the sleeve piston to the bolt carrier. In some firearm embodiments, first and second operating rods can be coupled to the sleeve piston at opposite, or substantially opposite, points on the sleeve piston such as at the top and bottom or at the left and right sides of the sleeve piston. The one or more operating rods can be permanently coupled to, detachably coupled to, or independent of the sleeve piston in any embodiment of the present invention. The sleeve piston can be coupled to a bolt carrier such as an AR-18, M-16, or AK-47-type bolt carrier in any embodiment of the present invention. A rotating bolt, such as a seven-lug AR-18 or M-16-type bolt, can be used with the bolt carrier of any embodiment. In the alternative, a tilting bolt can also be used with any embodiment of the present invention. The one or more operating rods can contact or strike the bolt carrier at one or more contact points or lobes. For example, in some embodiments of the present invention a first operating rod and a second operating rod contact the bolt carrier on opposite or substantially opposite points or sides of the bolt carrier or bolt. A spring over one or more operating rods can be used to return the sleeve piston to battery in any embodiment of the present invention. The gas block of any embodiment, including the firearm embodiments of the present invention, can be permanently coupled, detachably coupled, or integrated into or with a barrel.

Yet further embodiments of the present invention provide methods for operating a bolt carrier of a firearm using a sleeve piston, wherein the firearm includes a barrel coupled to a receiver, and wherein the bolt carrier is carried by the receiver. First, the firearm is used to fire a cartridge. Second, a gas produced by the fired cartridge is directed against a sleeve piston of one or more embodiments of the present invention. Third, the sleeve piston reciprocates or is moved rearward along the barrel in response to the gas. Fourth, one or more operating rods coupled to the sleeve piston can push, strike, or transfer an actuating force to the bolt carrier. One skilled in the art will appreciate that the methods can include or be used with any of the apparatus, system, method, and firearm embodiments of the present invention.

One of skill in the art will understand that any feature, element, or characteristic of any embodiment of the present invention can be used or combined with any feature, element, or characteristic of any other embodiment of the present invention. Unless otherwise expressly stated, it is in no way intended that any method or embodiment set forth herein be construed as requiring that its steps or actions be performed in a specific order. Accordingly, where a method, system, or apparatus claim for example does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of embodiments described in the specification.

BRIEF DESCRIPTION OF THE DRAWINGS

The accompanying drawings, which are incorporated in and constitute part of this specification, illustrate embodiments of the invention, and together with the description, serve to explain the principles of various embodiments of the invention. The embodiments described in the drawings and specification in no way limit or define the scope of the present invention.

Figure 1:
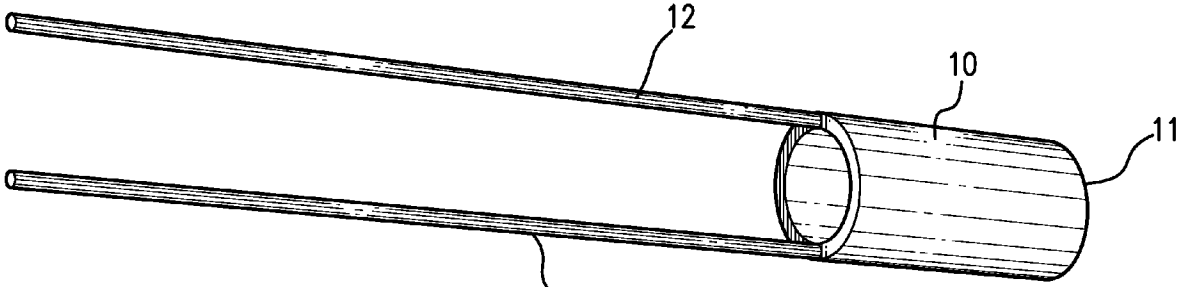
FIG. 1 is a view of one embodiment of the sleeve piston of present invention.

The present invention has been illustrated in relation to embodiments which are intended in all respects to be illustrative rather than restrictive. For example, a person skilled in the art will understand that the elements in the drawings are not limited to the specific dimensions shown, but are for illustrative purposes only. Those skilled in the art will further realize that the embodiments of the present invention are capable of many modifications and variations without departing from the scope of the present invention.

DESCRIPTION OF THE INVENTION

The various embodiments of the present invention relate generally to firearms, and more specifically to the use of a sleeve or hollow operating piston that extends partially or fully around the barrel of a firearm. Any suitable firearm and/or cartridge can be used with the embodiments of the present invention. By way of example the firearm of any embodiment of the present invention can comprise one or more of a rifle, short-barreled rifle, personal-defense weapon, carbine, pistol, shotgun, machine gun, grenade launcher, or cannon. By way of further example the cartridge can comprise one or more of a rim-fire, pistol, rifle, shotgun, or cannon cartridge. Accordingly embodiments of the invention can be used with weapon systems, by way of non-limiting example, ranging from .22 caliber rim-fire to 40 mm cannon. The 5.56 mm NATO cartridge, for example, can be used with any embodiment of the present invention.

While embodiments of the present invention can be used with any type of weapon, the embodiments are particularly useful for automatic and semi-automatic small arms (also referred to as "auto-loading" weapons) where gas from a fired cartridge is used to actuate a bolt carrier and thereby automatically load the next cartridge. Similarly, embodiments of the present invention can include or be used with a magazine that stores a plurality of cartridges, such as with an M-16 or AK-47-type magazine.

Figure 2:
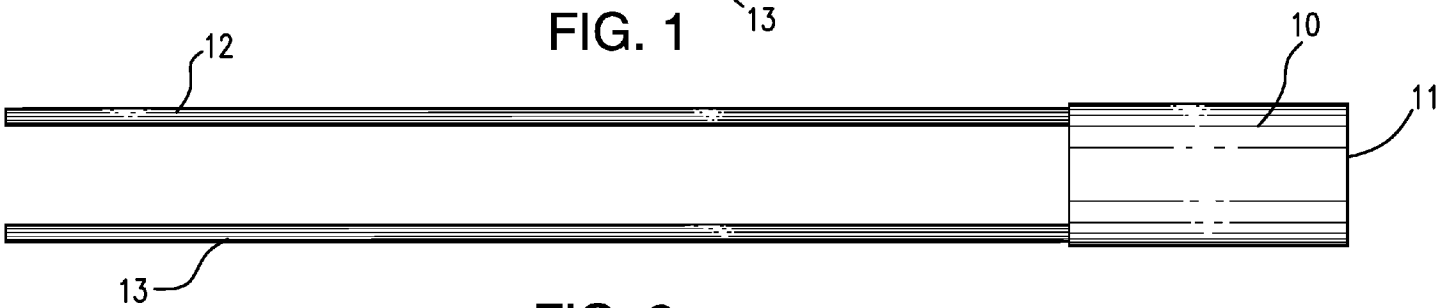
FIG. 2 is another view of the sleeve piston embodiment shown in FIG. 1.
Figure 3:
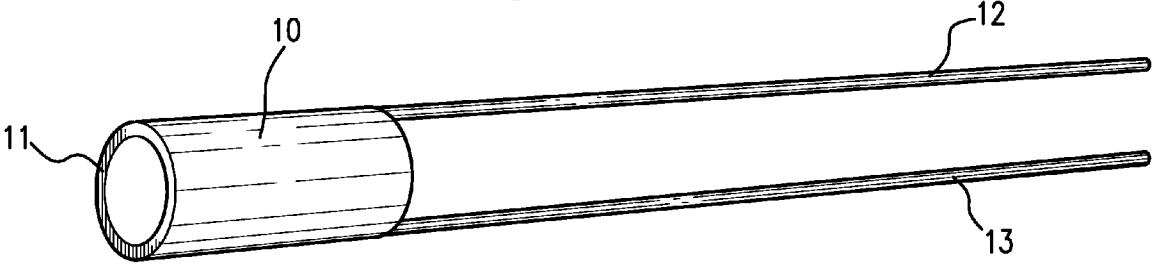
FIG. 3 is a further view of the sleeve piston embodiment shown in FIG. 1.

Accordingly, a first embodiment of the present invention as shown in FIGS. 1-3 provides a single or monolithic sleeve piston (10) that can extend around a firearm barrel and actuate a bolt carrier in response to a gas from a fired cartridge. The monolithic sleeve piston (10) can be coupled to one or more operating rods in embodiments of the present invention. As shown by way of example in FIGS. 1-3, a sleeve piston (10) can be coupled to a first operating rod (12) and a second operating rod (13), wherein the operating rods (12, 13) are located on opposite sides of the sleeve piston (10). The sleeve piston (10) also includes a piston face (11) that can receive gas from a fired cartridge. A monolithic sleeve piston (10) can comprise a single piece, such as a single cast or milled piece of metal such as steel, or it can be comprised of one or more pieces that are permanently or detachably coupled to produce a sleeve piston (10) that can extend around the barrel of a firearm.

Figure 4:
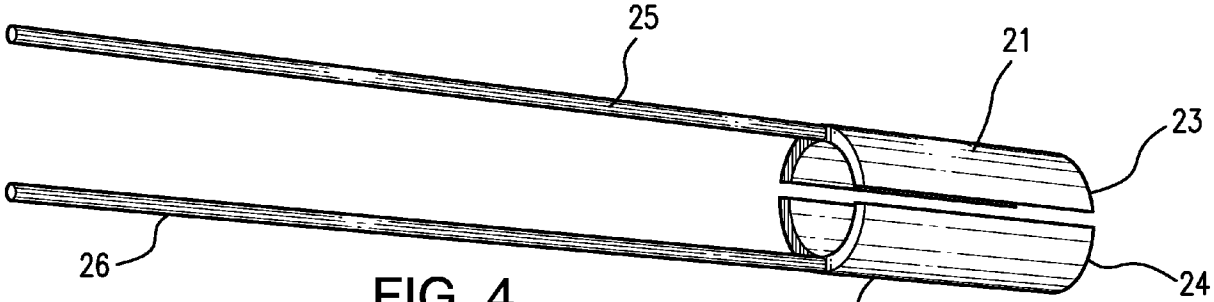
FIG. 4 is a view of another embodiment of the sleeve piston of present invention.
Figure 5:
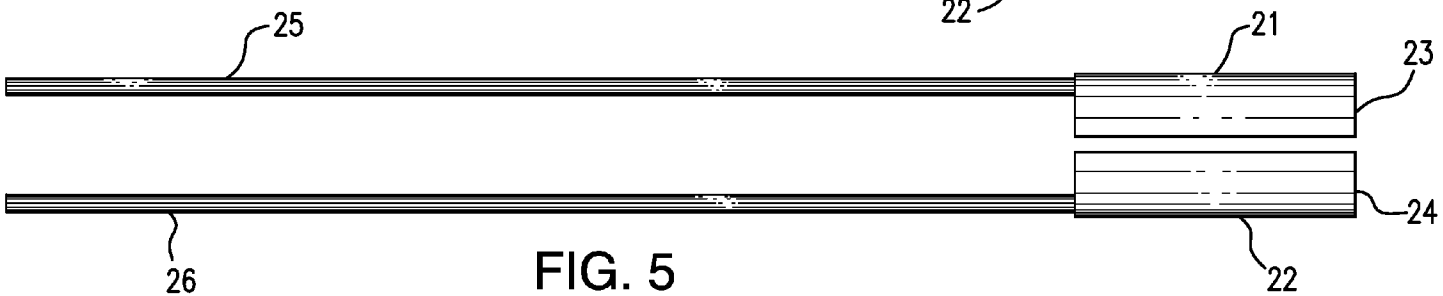
FIG. 5 is another view of the sleeve piston embodiment shown in FIG. 4.
Figure 6:
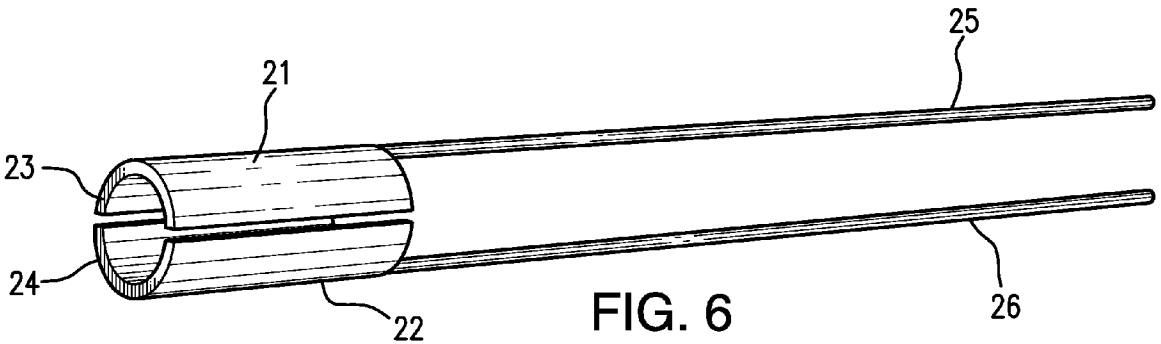
FIG. 6 is a further view of the sleeve piston embodiment shown in FIG. 4.

A second embodiment of the present invention as shown in FIGS. 4-6 provides a pseudo sleeve piston (20) comprising two or more sleeve parts (21, 22) wherein each sleeve part can be shaped around or along a portion of a firearm barrel. For example, as shown in FIGS. 4-6, a first sleeve part (21) and a second sleeve part (22) can be circular or semi-circular and therefore be shaped or curved around a firearm barrel. The sleeve piston (20) can be coupled to one or more operating rods in embodiments of the present invention. As shown by way of example in FIGS. 4-6, the first sleeve piston part (21) can be coupled to a first operating rod (25) and the second sleeve piston part (22) can be coupled to a second operating rod (26). Accordingly, each sleeve part (21, 22) can be coupled to an operating rod (25, 26) in embodiments of the present invention. Like the monolithic sleeve piston (10), the pseudo-sleeve piston (20) can be used to actuate a firearm bolt carrier in response to a gas from a fired cartridge. Each sleeve part (21, 22) such as sleeve part (21) can include a face (23) that receives a gas from a fired cartridge. The sleeve piston embodiments can be used with any other embodiment of the present invention including the systems, firearms, and methods disclosed herein.

The sleeve piston of embodiments of the present invention, as shown by way of non-limiting example in FIGS. 1-6, can comprise any suitable size, shape, and/or construction. By way of example, the monolithic sleeve piston of various embodiments can comprise a circular or semi-circular, such as elliptical or oval, or polygonal shape, or any combination thereof. Similarly, the part of a pseudo-sleeve piston can comprise any suitable size, shape, and/or construction. For example, a pseudo-sleeve piston part can comprise a semi-circular, such as elliptical or oval, or polygonal shape, or any combination thereof.

Embodiments of the present invention also provide various sleeve piston means. As used herein, sleeve piston means includes, but is not limited to, those sleeve piston structures described with respect to FIGS. 1-14 and 16-17. Monolithic sleeve piston means includes to the sleeve piston structures described with respect to FIGS. 1-3 and 7-10. Pseudo sleeve piston means includes those sleeve piston structures described with respect to FIGS. 4-6 and 11-14.

The sleeve piston of any embodiment of the present invention, such as those embodiments shown in FIGS. 1-6, can utilize one or more operating rods to transfer force to and thereby operate a bolt carrier. An operating rod can be permanently coupled to (such as when the sleeve piston and rod are a single manufacture), detachably coupled to, or independent from the sleeve piston in any embodiment of the present invention. By way of one example and as shown in FIGS. 1-3, the sleeve piston (10) and one or more operating rods (12, 13) can comprise a single piece of metal such as a single piece of cast or milled steel. In other embodiments the sleeve piston can be detachably coupled to one or more operating rods by means of a fastener such as a screw or pin, for example. In further embodiments the piston can be separate or independent from one or more operating rods so that the sleeve piston and the operating rod(s) can move independently from one another. In one example the sleeve piston and operating rod(s) can be independent but in direct or indirect physical contact when the bolt carrier is in battery. In further embodiments the sleeve piston can move a predetermined distance before it impacts or transfers force to one or more operating rods, thereby transferring its momentum to and operating a bolt carrier, such as the bolt carrier (70) shown in FIG. 15. The bolt carrier and operating rods(s) can be permanently coupled, detachably coupled, or independent in embodiments of the present invention.

As used herein, operating rod means includes, but is not limited to, the operating rod structures described with respect to FIGS. 1-14 and 16-17.

Figure 16:
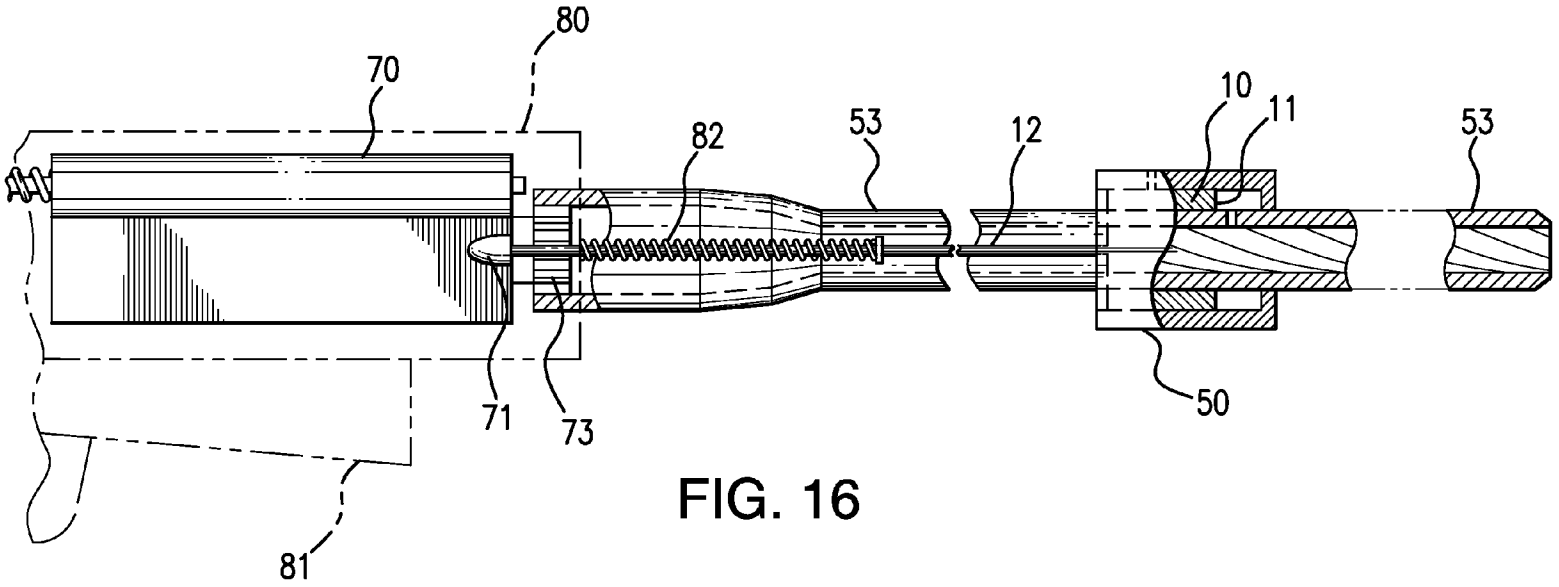
FIG. 16 is a partial cut-away side view of the system of one embodiment of the present invention.
Figure 17:
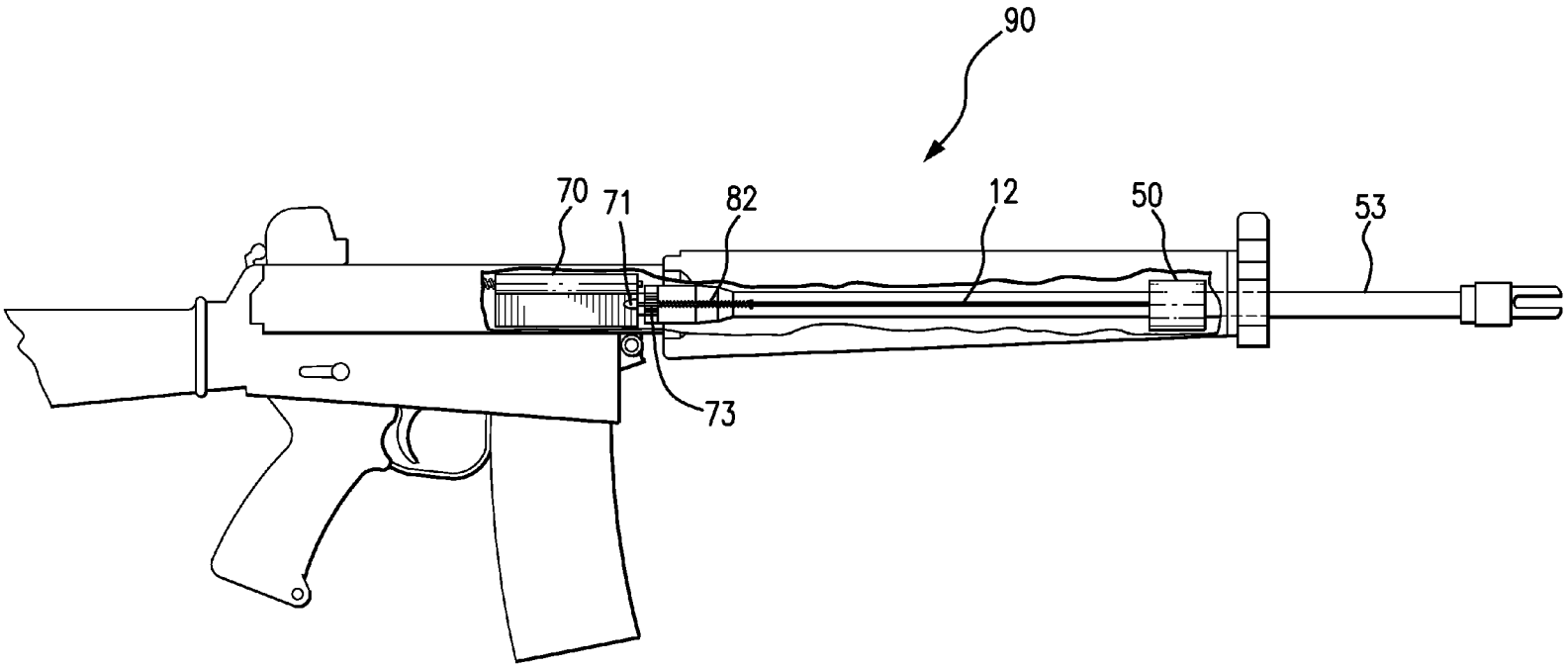
FIG. 17 shows a rifle of one embodiment of the present invention.

The operating rods of any embodiment can be coupled to the sleeve piston at opposite or substantially opposite points of the sleeve piston. For example, a first operating rod (12) and a second operating rod (13) are coupled to sleeve piston (10) at opposite points of the piston (10). Such an arrangement allows, for example, a first operating rod (12) to be located above a barrel and a second operating rod (13) to be located below the barrel. In the alternative, a first operating rod (12) can be located on the right side of a barrel and a second operating rod (13) can be located on the left side of the barrel in embodiments of the present invention, such as shown in FIGS. 16-17. Similarly, the sleeve parts (21, 22) can be located above and below, or on the right and left sides of, a barrel.

Further embodiments of the present invention can provide a barrel that includes a recess or groove longitudinally along the barrel. An operating rod (12, 13, 25, 26) can be at least partially located in the recess and thereby reduce the distance that the operating rod protrudes beyond the diameter of the barrel.

The sleeve piston embodiments described herein, such as the sleeve pistons shown in FIGS. 1-6, can provide several advantages over conventional piston-driven systems. Dual operating rods, including symmetrically and/or substantially symmetrically located operating rods, such as those shown in FIGS. 1-14 and 16-17, can be used to create symmetrical reciprocating mass about a barrel and therefore minimize torque or "muzzle file," thereby making a semi- or fully automatic firearm much easier to control.

As understood by one skilled in the art, semi- and fully automatic firearms can create tremendous and deleterious heat from rapid—yet often necessary—firing. For example, an M-16A2 can rupture its barrel after only 491 rounds, achieving a barrel temperature of around 1600 degrees F. *Fire to Destruction Test of* 5.56 *M4A1 Carbine and M16A2 Rifle Barrels, Final Report*, Jeff Windham, Small Arms Branch, Engineering Support Directorate, Rock Island Arsenal, September 1996, page 2. This illustrates the need to fully ventilate the barrel of an auto-loading rifle.

Figure 7:
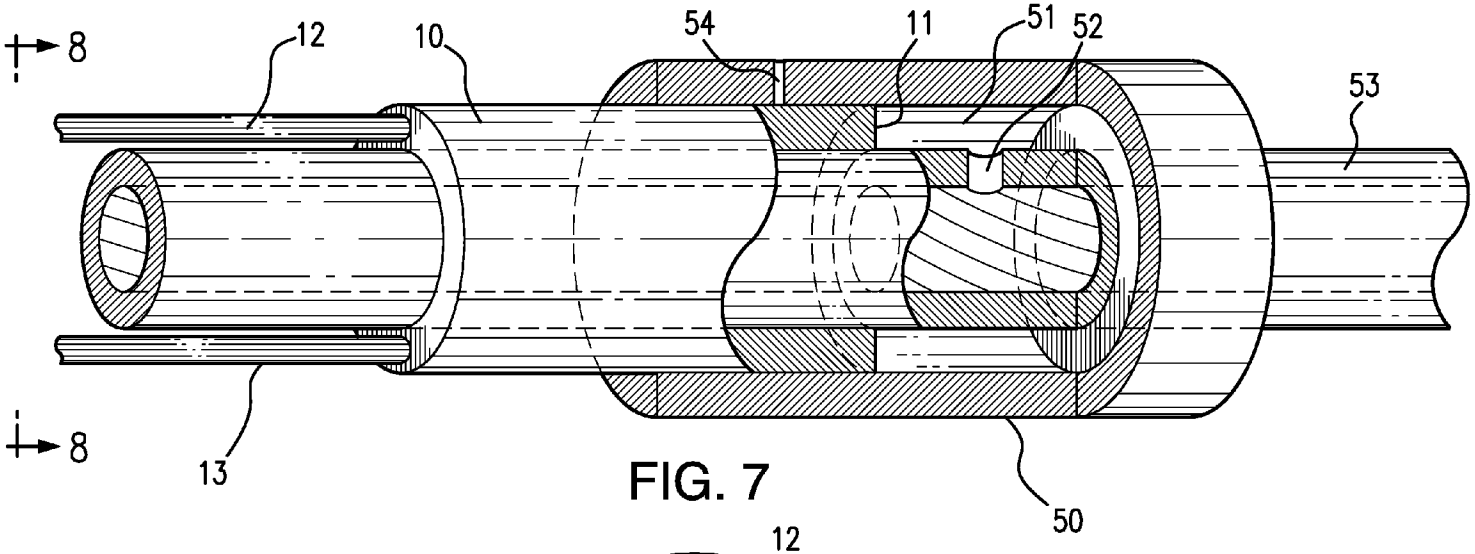
FIG. 7 is a partial cut-away view of one embodiment of the present invention including a monolithic sleeve piston and a gas block.

The sleeve piston embodiments of the present invention are thus beneficial because they can provide for a lower barrel temperature. First, as shown in FIGS. 1-14 and 16-17, for example, the first and second operating rods (12, 13, 25, 26) allow air to fully circulate around the barrel, thereby cooling it. In other words, the first and second operating rods (12, 13, 25, 26) do not trap hot air against the barrel. Second, the sleeve piston (10, 20) such as the one shown in FIG. 7 can conduct heat away from the barrel, thereby cooling it. In a conventional piston-driven system such as the AK-47, the piston is offset and thus not in direct or close indirect contact with the barrel. In contrast, the sleeve piston (10, 20) embodiments of the present invention can be in close, if not direct, contact with the barrel as shown in FIGS. 7-14 and so can transfer heat directly away from the barrel, thereby cooling it. In other words, the sleeve piston (10, 20) can act like a heat sink for the barrel. As shown in FIG. 7, for example, the inner surface of the piston (10) is in direct contact with the barrel, facilitating the transfer of heat. The outer surface of the piston (10, 20) is in contact with the gas block (50, 60), also transferring heat away from the barrel. In embodiments where one or more operating rods (12, 13, 25, 26) are coupled to the sleeve piston (10, 20), such as shown in FIGS. 7-14, the one or more operating rods can also act to helpfully transfer heat away from the barrel and into the air due to the high surface area to volume ratio of the operating rods. Accordingly, the sleeve piston embodiments of the present invention, such as those shown in FIGS. 1-14 and 16-17, not only fully expose the barrel to air but can also transfer heat away from the barrel to further aid cooling.

Further embodiments of the present invention, such as those shown in FIGS. 7-14, provide systems for actuating a bolt carrier of a firearm using the sleeve piston embodiments of the present invention. One example of a bolt carrier (70) useable with embodiments of the present invention is shown in FIG. 15. A person of ordinary skill in the art will recognize the bolt carrier (70) as a bolt carrier from an ARMALITE AR-18/180 modified for use with embodiments of the present invention. Specifically, the bolt carrier (70) has been modified to include a first strike surface (71) or lobe and a second strike surface (72) or lobe. The first strike surface (71) receives an operating force or push from a first operating rod, such as operating rod (12), and the second strike surface (72) receives an operating force or push from a second operating rod, such as operating rod (13). While the bolt carrier (70) depicted in FIG. 15 is based on an ARMALITE AR-18/180 bolt carrier, any suitable bolt carrier can be used with embodiments of the present invention. For example, while the strike surfaces (71, 72) of FIG. 15 are symmetrically located about the right and left sides of the bolt (73), the strike surfaces of other embodiments can be located above and below the bolt (73) in embodiments of the present invention. Similarly, the strike surfaces can be located asymmetrically about a bolt in yet further embodiments of the present invention. For example, both strike surfaces could be located above, or below, the bolt (73). Of course, for embodiments of the invention that utilize a sleeve piston with a single operating rod, the bolt carrier, such as bolt carrier (70), can include a single strike surface. By way of a further example, a person skilled in the art will understand that an M-16 bolt carrier could be modified for use with embodiments of the present invention, such as with sleeve piston (10), by adding strike surfaces like the strike surfaces (71, 72) shown in FIG. 15 to the left and right sides of the bolt carrier face, for example.

As used herein, bolt carrier means includes, but is not limited to, the bolt carrier (70) structure described with respect to FIGS. 15-17. Bolt means also includes, but is not limited to, the bolt (73) structure described with respect to FIGS. 15-17.

Figure 8:
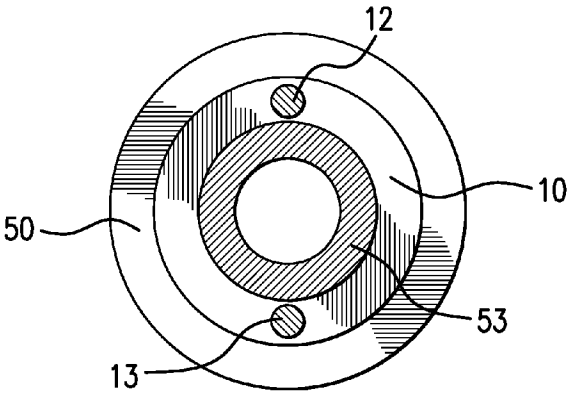
FIG. 8 is a sectional front view of the embodiment shown in FIG. 7.

Returning to the system shown in FIG. 7, one embodiment of the present invention provides a monolithic sleeve piston (10) that can reciprocate along a barrel (53) to actuate a bolt carrier, such as bolt carrier (70). A gas block (50) is coupled to the barrel (53), wherein the gas block (50), sleeve piston (10), and barrel (53) define a cylindrical gas chamber (51) that can receive a gas from a fired cartridge. Gas from a fired cartridge is transferred from the barrel (53) and into the gas chamber (51) through a gas port (52), wherein the gas subsequently acts against the face (11) of the sleeve piston (10) to thereby move the sleeve piston (10) rearward to operate a bolt carrier such as bolt carrier (70). FIG. 8 provides an additional image showing an arrangement of the sleeve piston (10), operating rods (12, 13), barrel (53), and gas block (50) of FIG. 7.

Figure 9:
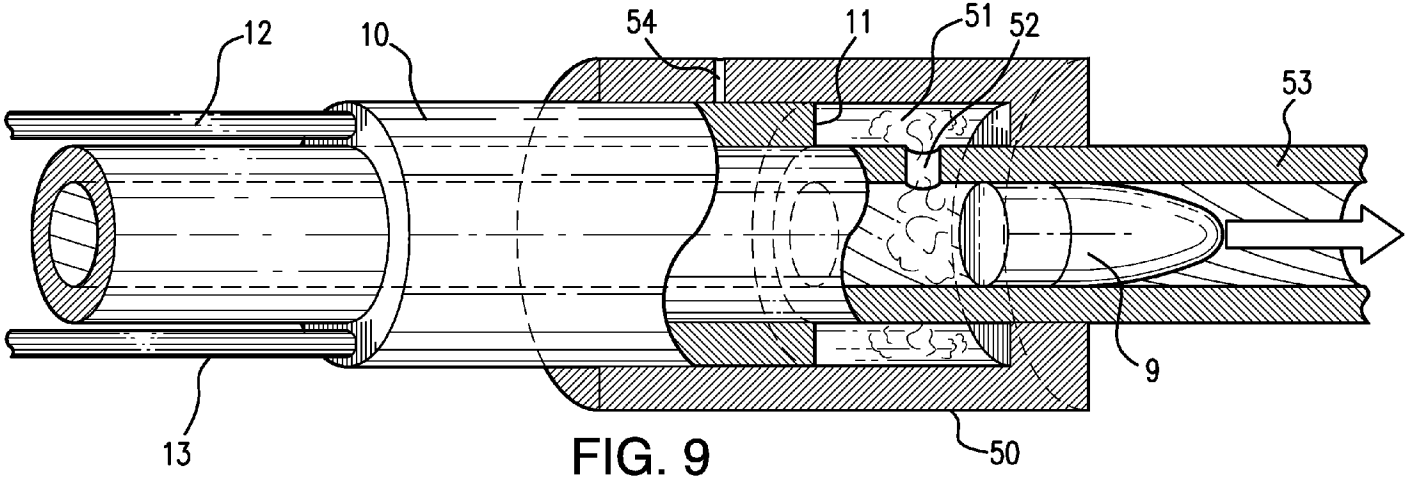
FIG. 9 is a partial cut-away view of the embodiment of FIG. 7 with a projectile at a first time.
Figure 10:
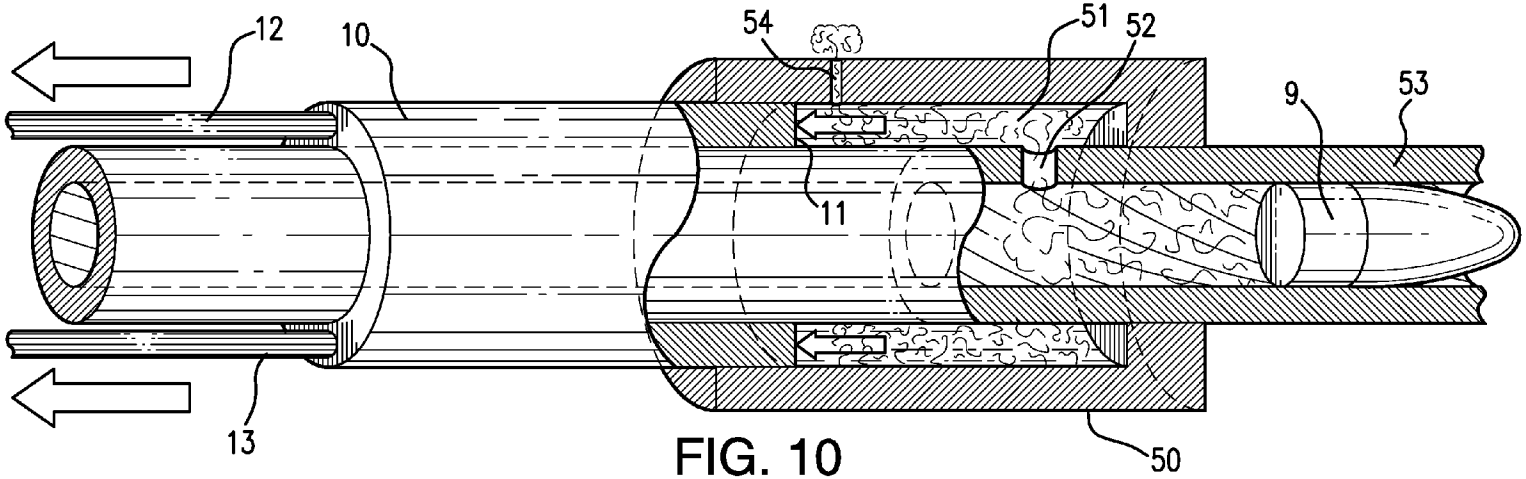
FIG. 10 is a partial cut-away view of the embodiment of FIG. 7 with the projectile at a later time.

FIGS. 9 and 10 show operation of the system of FIG. 7 after the bullet (9) from a fired cartridge has passed the gas port (52). FIG. 9 shows the moment in time just after the bullet (9) has passed the gas port (52). As shown, gas from the fired cartridge travels from the barrel (53), through the gas port (52), and into the gas chamber (51) where it exerts force on the face (11) of the sleeve piston (10). The gas in FIG. 9 has not yet moved the sleeve piston (10) towards a bolt carrier.

The position of the bullet (9) in FIG. 10 is for illustrative purposes only and is used to show the system of FIG. 9 at a point later in time. As understood by a person skilled in the art, the bullet (9) may be much farther down the barrel (53), if not having exited the barrel (53), before the sleeve piston (10) has moved far enough to pass the gas vent (54) in a real rifle that implements the system shown in FIG. 7. The same illustrative principle is also used for FIGS. 11-14.

Returning to FIG. 10, it can be seen that a gas in the gas chamber (51) has pushed the sleeve piston (10) rearward (in the direction of the arrows) towards a bolt carrier, such as bolt carrier (70). The sleeve piston face (11) has passed an exhaust port (54), thereby venting gas from the gas chamber (51) and rapidly lowering the force exerted by the gas on the sleeve piston (10). The gas vent (54) can have any suitable size, shape, and location in embodiments of the present invention.

Figure 11:
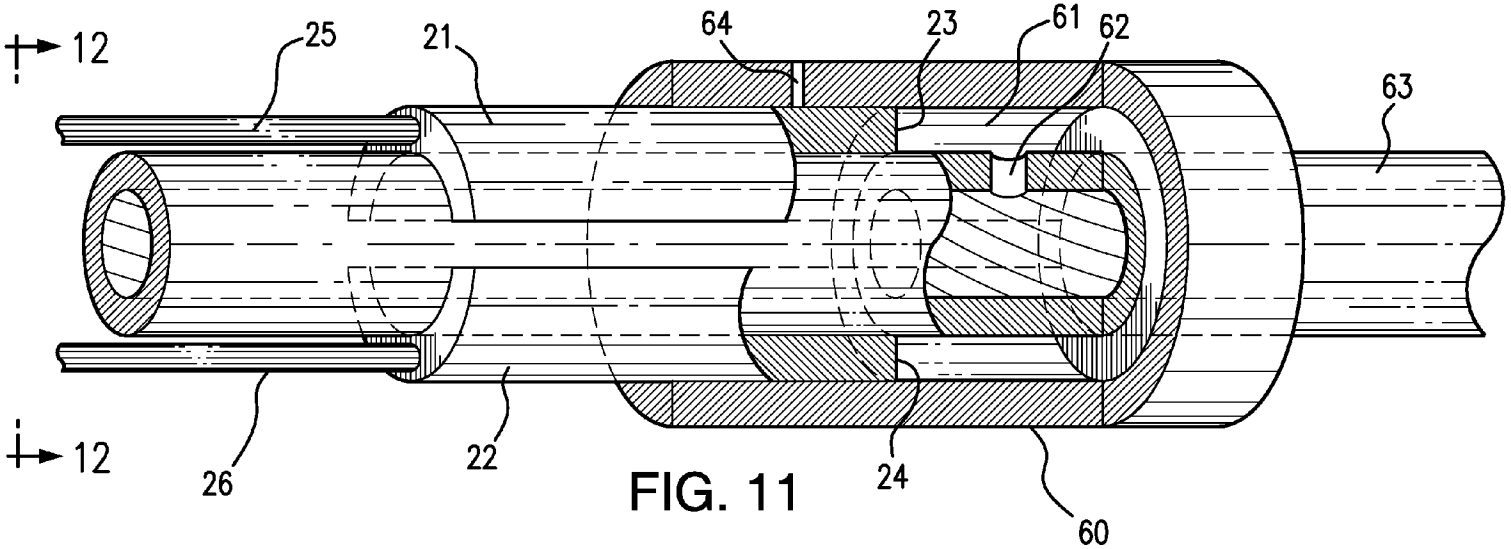
FIG. 11 is a partial cut-away view of one embodiment of the present invention including a pseudo-sleeve piston and a gas block.
Figure 12:
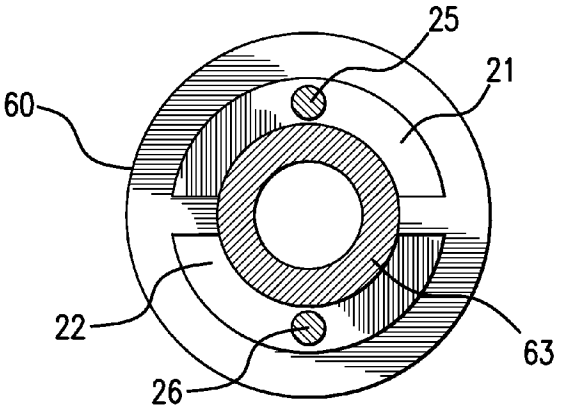
FIG. 12 is a sectional front view of the embodiment shown in FIG. 11.

FIGS. 11-14 illustrate systems of additional embodiments of the present invention that include a pseudo or multi-part sleeve piston (20). One embodiment as shown in FIG. 11 provides a sleeve piston (20) that can reciprocate along a barrel (63) to actuate a bolt carrier, such as bolt carrier (70). A gas block (60) is coupled to the barrel (63), wherein the gas block (60), sleeve piston (20), and barrel (63) define a gas chamber (61) that can receive a gas from a fired cartridge. As shown in FIG. 11, a gas from a fired cartridge is transferred from the barrel (63) and into the gas chamber (61) through a gas port (62), wherein the gas subsequently acts against the face of each sleeve part (23, 24) to thereby move the sleeve piston (20) rearward to operate a bolt carrier (70). FIG. 12 provides an additional image showing arrangement of the sleeve piston (20), operating rods (25, 26), barrel (63), and gas block (60) of FIG. 11.

Figure 13:
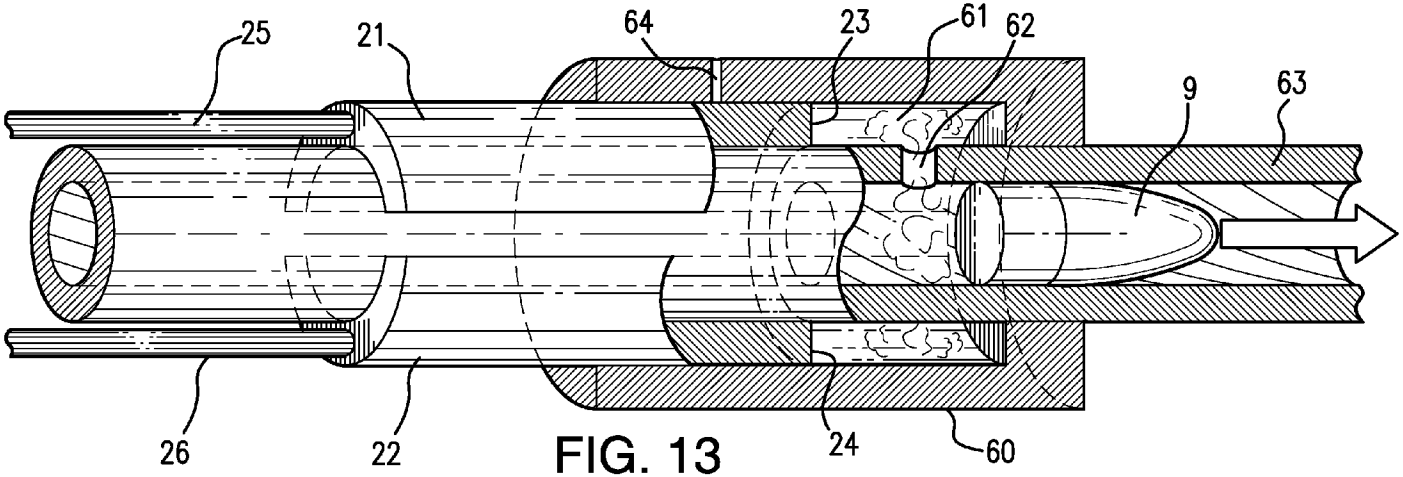
FIG. 13 is a partial cut-away view of the embodiment of FIG. 11 with a projectile at a first time.
Figure 14:
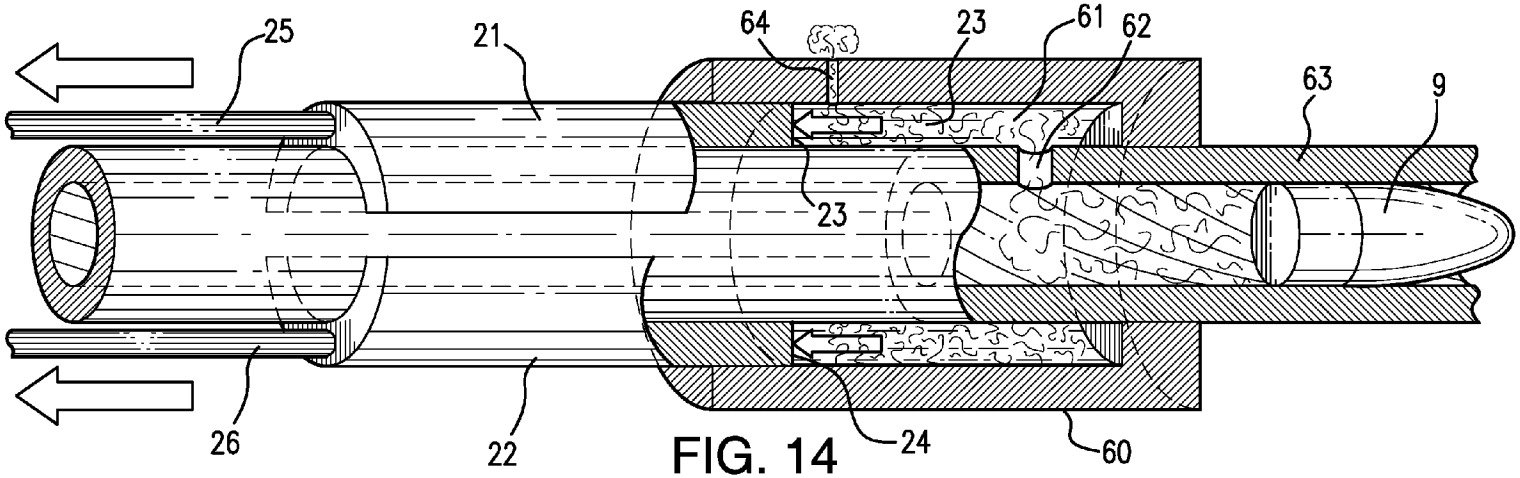
FIG. 14 is a partial cut-away view of the embodiment of FIG. 11 with the projectile at a later time.
Figure 15:
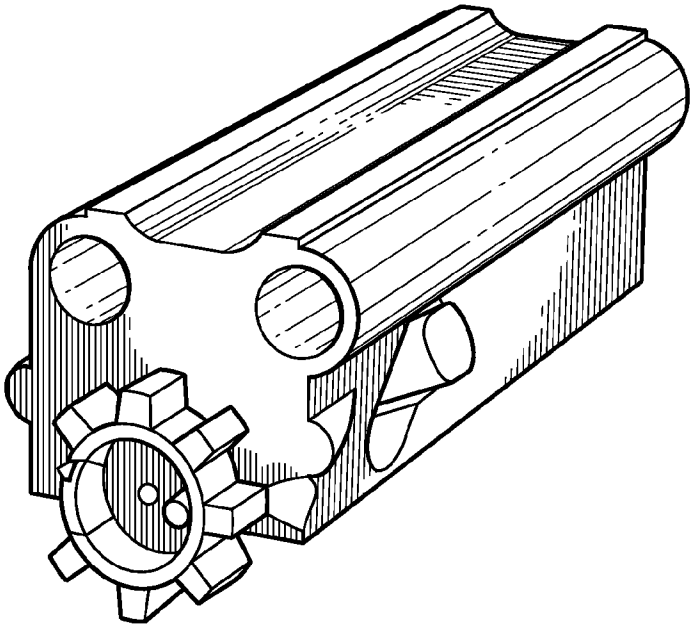
FIG. 15 is a view of a bolt carrier and bolt of one embodiment of the present invention.

FIGS. 13 and 14 show operation of the system of FIG. 11 after the bullet (9) from a fired cartridge has passed a gas port (62). FIG. 13 shows the moment in time just after the bullet (9) has passed the gas port (62). As shown in FIG. 13, a gas from the fired cartridge travels from the barrel (63), through the gas port (62), and into the gas chamber (61) where it exerts force on the face (23) of the first sleeve part (21) and force on the face (24) of the second sleeve part (22). The gas in FIG. 13 has not yet moved the sleeve piston (20) towards a bolt carrier.

As shown in FIG. 14, a gas in the gas chamber (61) has pushed the sleeve piston (20) rearward (in the direction of the arrows) towards a bolt carrier, such as a bolt carrier (70). The faces (23, 24) of the sleeve piston (20) have passed an exhaust port (64), thereby venting gas from the gas chamber (61) and rapidly lowering the force exerted by the gas on the first (21) and second (22) piston parts. The gas vent (64) can have any suitable size, shape, and location in embodiments of the present invention.

As used herein, gas block means includes, but is not limited to, the gas block structures (50, 60) shown and described with regard to FIGS. 7-14. Monolithic gas block means includes, but is not limited to, the gas block structure (50) described with regard to FIGS. 7-10. Pseudo-sleeve gas block means includes, but is not limited to, the gas block structure (60) described with regard to FIGS. 11-14.

FIG. 16 illustrates embodiments of the present invention in view of a firearm. FIG. 16 shows illustrative systems including the sleeve piston (10) of FIGS. 1-3, the sleeve piston systems of FIGS. 7-10, and the bolt carrier (70) of FIG. 15. A person skilled in the art will recognize that the receiver (80, 81) carrying bolt carrier (70) resembles the receiver of an ARMALITE AR-18/180. A person skilled in the art understands however that the embodiments of the present invention are not so limited to the AR-18/180 rifle.

As shown in FIG. 16, a spring (82) over an operating rod (12) can be used to return the sleeve piston (10) to battery. Thus in various embodiments where a sleeve piston (10, 20) is coupled to an operating rod (12, 13, 25, 26) and the piston and rods move independently from a bolt carrier (70), a mainspring can be used to return the bolt carrier (70) to battery and a spring (82) over the operating rod(s) (12, 13, 25, 26) can be used to return the sleeve piston (10, 20) to battery soon after it transfers its momentum to the bolt carrier (70). In other embodiments a firearm's primary recoil spring or mainspring can be used to return the piston to battery, for example, when the bolt carrier (70), rod(s) (12, 13, 25, 26) and piston (10, 20) reciprocate as a single unit (as in an AK-47).

A rifle (90) of one embodiment of the present invention is shown in FIG. 17, showing the system of FIG. 16 incorporated into ARMALITE AR-18/180 rifle. As used herein, rifle means includes, but is not limited to, the structures described with respect to FIG. 17. As shown in FIG. 17, the rifle (90) of embodiments of the present invention can include, by way of non-limiting example, the sleeve piston systems described with respect to FIG. 16 including one or more of gas block (50), sleeve piston (10), operating rods (12, 13), return spring (82), bolt carrier (70), bolt (73), and barrel (53). The rifle (90) can likewise include or utilize the sleeve pistons described with respect to FIGS. 1-6 and the sleeve piston systems described with respect to FIGS. 7-14. Moreover, the methods of any embodiment of the present invention, including those described with respect to FIG. 18, can be used with any of the aforementioned rifles of the present invention. Of course, a person skilled in the art will recognize that the sleeve piston apparatuses, systems, and methods of the present invention are not limited to use with AR-18-type rifles but can be used with any suitable type of rifle, such as M-16 and AK-47-type rifles.

Figure 18:
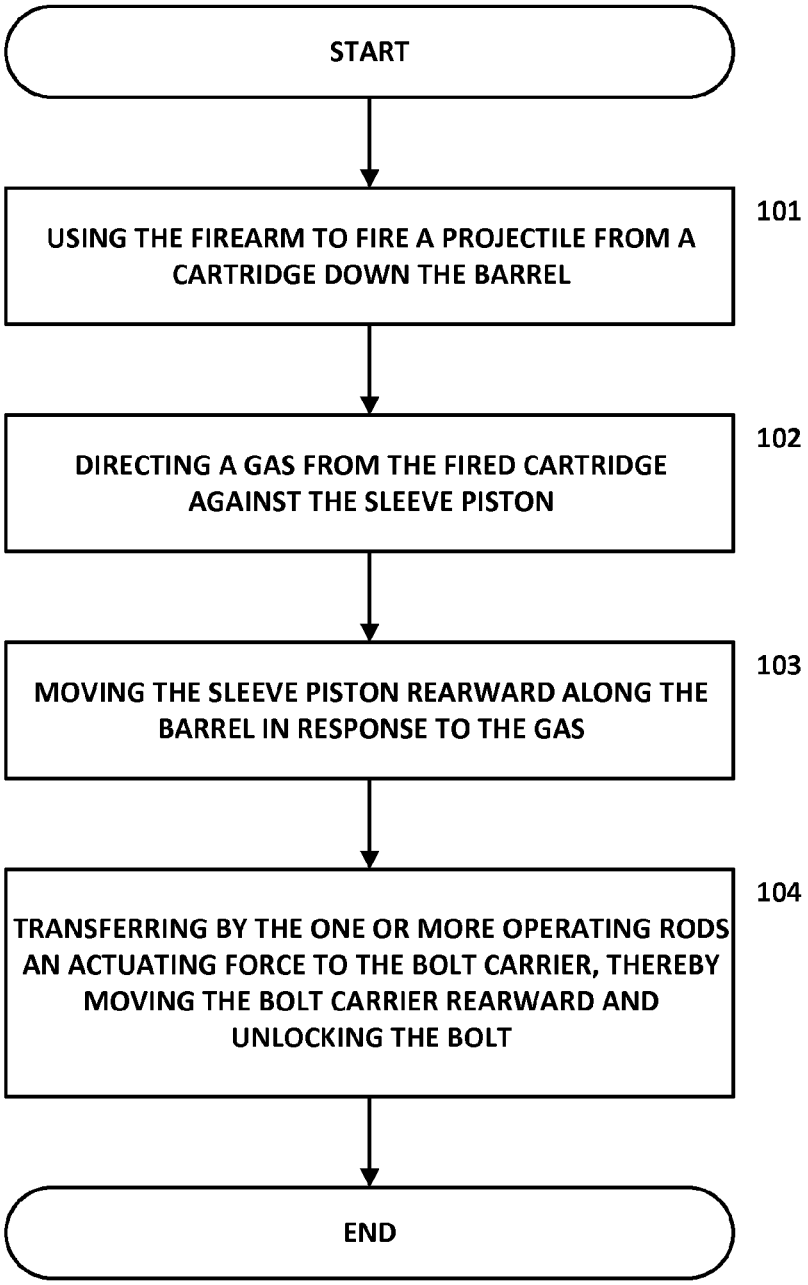
FIG. 18 illustrates the method of one embodiment of the present invention for operating the bolt carrier of a firearm.

Additional embodiments of the present invention provide methods for actuating or operating a bolt carrier of a firearm using a sleeve piston, wherein the firearm includes a barrel coupled to a receiver, and wherein the bolt carrier is carried by the receiver. One such method for operating the bolt carrier of a firearm is shown in FIG. 18. The firearm (90) can include a barrel (53, 63) coupled to a receiver, with the bolt carrier (70) carried by the receiver and carrying a bolt (73). The method can comprise first using (101) the firearm (90) to fire a projectile (9) from a cartridge down the barrel (53, 63). Second, a gas from the fired cartridge is directed (102) against the sleeve piston (10, 20). The sleeve piston can comprise a monolithic sleeve piston (10) as shown in FIGS. 1-3 and 7-10, for example. The sleeve piston can also comprise, in the alternative, a pseudo sleeve piston (20) such as shown in FIGS. 4-6 and 11-14. One skilled in the art will appreciate that any suitable sleeve piston can be used with the methods of the present invention.

The sleeve piston of various methods can use one or more operating rods as shown in FIGS. 1-14 to transfer an operating force to a bolt carrier, wherein the bolt carrier includes, but is not limited to, bolt carrier (70). For example as shown in FIGS. 1-3, the sleeve piston (10) and one or more operating rods (12, 13) can comprise a single piece of metal such as a single piece of cast or milled steel. In other embodiments the sleeve piston can be detachably coupled from one or more operating rods by means of a fastener such as a screw or pin, for example. In further embodiments the piston can be separate or independent from one or more operating rods so that the sleeve piston and the operating rod(s) can move independently from one another. In one method the sleeve piston and operating rod(s) can be independent but in direct or indirect physical contact when the bolt carrier (70) is in battery. In further embodiments the sleeve piston can move a predetermined distance before it impacts or transfers force to one or more operating rods, thereby transferring its momentum to and operating a bolt carrier, such as the bolt carrier shown in FIG. 15. The bolt carrier and operating rods(s) can be permanently coupled, detachably coupled, or independent in the methods or embodiments of the present invention.

Third, the sleeve piston (10, 20) reciprocates or is moved (103) rearward along the barrel (53, 63) in response to the gas. The sleeve piston of any method can be movably received by a gas block, such as gas block (50) or gas block (60), to define a gas or expansion chamber (51, 61). The gas block can be permanently or detachably coupled to a barrel (53, 63), or the gas block and barrel can comprise a single unit of manufacture. For example, in one method a sleeve piston (10) can comprise a circular shape and can reciprocate in a corresponding circular sleeve cylinder gas block to define a gas chamber, such as shown in FIGS. 7-10. The gas block can be detachably coupled to the barrel by a fastener such as by one or more pins or screws, or it can be machined from the barrel itself in embodiments of the invention. One or more gas ports, such as gas port (52), can couple the gas chamber to the barrel in the methods of the present invention. Accordingly, the step of moving (103) can further comprise the sleeve piston reciprocating or moving in a gas block coupled to a barrel as shown, for example, in FIGS. 7-14.

Fourth, one or more operating rods (12, 13, 25, 26) coupled to the sleeve piston (10, 20) push, strike, or transfer (104) an actuating force to the bolt carrier (70), thereby moving the bolt carrier (70) rearward and unlocking the bolt (73). The sleeve piston of any method can be coupled to a bolt carrier, such as bolt carrier (70), that reciprocates in a straight light with respect to the barrel. For example, an AR-18/180 (70), M-16, or AK-47-type bolt carrier can be used in any method of the present invention. The bolt carrier can include a rotating bolt, such as a seven-lug AR-18 or M-16-type bolt (73) shown in FIG. 15. Any suitable rotating bolt can be used. The one or more operating rods (12, 13, 25, 26) can contact or strike the bolt carrier (70) at one or more contact points or lobes (71, 72). For example, in some methods of the present invention a first operating rod (12) and a second operating rod (13), such as those shown in FIGS. 1-6, can contact the bolt carrier on opposite or substantially opposite points or sides of the bolt carrier (70) or bolt (73).

Thus, for example, the step of operating (104) the bolt carrier can comprise operating a bolt carrier (70) that carries a non-tiling rotating bolt (73) in embodiments of the present invention. In further embodiments, the step of operating (104) the bolt carrier can comprise directly pushing, striking, or contacting the bolt carrier with one or more operating rods (12, 13, 25, 26) such as shown in FIG. 16. In further embodiments the one or more operating rods (12, 13, 25, 26) can indirectly transfer force to the bolt carrier (70) such as by pushing or striking an intermediate object, such as one or more secondary operating rods situated between the operating rods (12, 13, 25, 26) and bolt carrier (70). One skilled in the art will appreciate that the methods can include or be used with any of the apparatus, system, method, and firearm embodiments of the present invention.

While the invention has been described in detail in connection with specific embodiments, it should be understood that the invention is not limited to the above-disclosed embodiments. Rather, a person skilled in the art will understand that the invention can be modified to incorporate any number of variations, alternations, substitutions, or equivalent arrangements not heretofore described, but which are commensurate with the spirit and scope of the invention. Specific embodiments should be taken as exemplary and not limiting.

I claim:

1. A system for operating a firearm bolt carrier, wherein the firearm fires one of a centerfire rifle or centerfire pistol cartridge, the system comprising:

a receiver that carries the bolt carrier, wherein the bolt carrier includes a first strike surface and a second strike surface for receiving operating forces;

a barrel coupled to the receiver, wherein the barrel includes a gas port for tapping expansion gases from the barrel;

a monolithic sleeve piston that extends around the rifled barrel, wherein the monolithic sleeve piston acts to operate the bolt carrier in response to the expansion gases and to draw heat away from the barrel;

an expansion chamber that receives the expansion gases from the gas port and that moveably receives the monolithic sleeve piston, wherein the expansion gases in the expansion chamber act against the monolithic sleeve piston and thereby move it towards the bolt carrier;

a first operating rod for transferring a first operating force from the monolithic sleeve piston to the first strike surface of the bolt carrier; and a second operating rod for transferring a second operating force from the monolithic sleeve piston to the second strike surface of the bolt carrier.

2. The system of claim 1, further comprising a first spring located over at least a part of the first operating rod for returning the first operating rod and the monolithic sleeve piston to battery.

3. The system of claim 2, further comprising a second spring located over at least a part of the second operating rod for returning the second operating rod and the monolithic sleeve piston to battery.

4. The system of claim 1, wherein the firearm can fire semi-automatically.

5. The system of claim 1, wherein the firearm can fire fully-automatically.

6. The system of claim 1, wherein the firearm comprises a rifle.

7. The system of claim 1, wherein the firearm comprises a short-barreled rifle.

8. The system of claim 1, wherein the firearm comprises a personal-defense weapon.

9. The system of claim 1, wherein the firearm fires 5.56 NATO cartridges.

10. The system of claim 1, wherein the firearm fires 7.62 NATO cartridges.

11. The system of claim 1, wherein the first operating rod and the second operating rod are moveably received through the receiver to strike the bolt carrier.

12. The system of claim 1, wherein the first operating rod is located on one side of the barrel and the second operating rod is located on an opposite side of the barrel.

13. The system of claim 1, wherein at least one of the first operating rod and the second operating rod is permanently coupled to the monolithic sleeve piston.

14. The system of claim 1, wherein at least one of the first operating rod and the second operating rod is detachably coupled to the monolithic sleeve piston.

15. The system of claim 1, wherein at least one of the first operating rod and the second operating rod moves independently from the monolithic sleeve piston.

16. The system of claim 1, wherein the monolithic sleeve piston moves a predetermined distance in response to the expansion gases before transferring an operating force to at least one of the first operating rod and the second operating rod.

17. The system of claim 1, further comprising a gas block coupled to the barrel, and wherein the monolithic sleeve piston is moveably received in the gas block to define the expansion chamber.

18. The system of claim 1, further comprising a bolt carried by the bolt carrier.

19. The system of claim 18, wherein the first strike surface and the second strike surface are located on opposite sides of the bolt.

20. The system of claim 18, wherein the bolt comprises a non-tilting rotating bolt.

* * * * *